US009105986B2

(12) United States Patent
Mahanfar et al.

(10) Patent No.: US 9,105,986 B2
(45) Date of Patent: Aug. 11, 2015

(54) CLOSELY SPACED ANTENNAS ISOLATED THROUGH DIFFERENT MODES

(71) Applicants: Alireza Mahanfar, Bellevue, WA (US); Elmer S. Cajigas, Sammamish, WA (US); Paul O'Brien, Sammamish, WA (US); Ronald B. Smith, Woodinville, WA (US); Pia Santelices, Redmond, WA (US)

(72) Inventors: Alireza Mahanfar, Bellevue, WA (US); Elmer S. Cajigas, Sammamish, WA (US); Paul O'Brien, Sammamish, WA (US); Ronald B. Smith, Woodinville, WA (US); Pia Santelices, Redmond, WA (US)

(73) Assignee: Microsoft Technology Licensing, LLC, Redmond, WA (US)

( * ) Notice: Subject to any disclaimer, the term of this patent is extended or adjusted under 35 U.S.C. 154(b) by 198 days.

(21) Appl. No.: 13/829,789

(22) Filed: Mar. 14, 2013

(65) Prior Publication Data

US 2014/0266937 A1 Sep. 18, 2014

(51) Int. Cl.

| | |
|---|---|
| ***H01Q 1/52*** | (2006.01) |
| ***H01Q 1/24*** | (2006.01) |
| ***H01Q 21/28*** | (2006.01) |
| ***H01Q 7/00*** | (2006.01) |
| ***H01Q 9/00*** | (2006.01) |
| ***H01Q 13/10*** | (2006.01) |

(52) U.S. Cl.

CPC ..... *H01Q 21/28* (2013.01); *H01Q 1/521* (2013.01); *H01Q 7/00* (2013.01); *H01Q 9/00* (2013.01); *H01Q 13/10* (2013.01)

(58) Field of Classification Search

CPC ..... H01Q 1/521; H01Q 1/243; H01Q 13/10; H01Q 21/28

USPC ..... 343/725, 702, 726, 767, 727

See application file for complete search history.

(56) References Cited

U.S. PATENT DOCUMENTS

| | | | | |
|---|---|---|---|---|
| 6,583,765 | B1 | 6/2003 | Schamberger et al. | |
| 7,916,089 | B2 | 3/2011 | Schlub et al. | |
| 8,115,686 | B2 * | 2/2012 | Mumbru et al. | 343/702 |
| 8,531,337 | B2 * | 9/2013 | Soler Castany et al. | 343/702 |
| 2003/0193437 | A1 | 10/2003 | Kangasvieri et al. | |
| 2006/0262026 | A1 | 11/2006 | Gainey et al. | |
| 2008/0198082 | A1 | 8/2008 | Soler Castany et al. | |
| 2009/0323652 | A1 | 12/2009 | Chen et al. | |
| 2010/0220034 | A1 | 9/2010 | Le et al. | |
| 2012/0139793 | A1 | 6/2012 | Sharawi | |
| 2012/0169552 | A1 | 7/2012 | Lee et al. | |
| 2013/0234911 | A1 * | 9/2013 | Lee | 343/893 |
| 2014/0139391 | A1 * | 5/2014 | Lo et al. | 343/841 |

OTHER PUBLICATIONS

"International Search Report & Written Opinion for PCT Patent Application No. PCT/US2014/019124", Mailed Date: May 13, 2014, Filed Date: Feb. 27, 2014, 10 Pages.

Caimi, et al., "Isolated Mode Antenna Technology", Published on: Jan. 2008, Available at: http://skycross.com/Technology/Whitepapers/iMAT.pdf.

Mak, et al., "Isolation Enhancement Between Two Closely Packed Antennas", In Proceedings of IEEE Transactions on Antennas and Propagation, vol. 56, No. 11, Nov. 14, 2008, 9 pages.

Desclos, Laurent, "Advances in High-Performance Ceramic Antennas for Small-Form-Factor, Multi-Technology Devices", Retrieved on: Jul. 11, 2012, Available at: http://www.antennasonline.com/images/Whitepapers/EthertronicsPaper.pdf.

* cited by examiner

*Primary Examiner* — Hoang V Nguyen

(74) *Attorney, Agent, or Firm* — Micky Minhas

(57) ABSTRACT

Multi-antenna systems, including mobile devices having multiple antennas, are provided herein. A first antenna and a second antenna are operable at two or more of the same non-overlapping communication frequency bands. The first antenna and the second antenna are closely spaced and have different fundamental modes of operation such that the first antenna and second antenna are substantially isolated at the two or more non-overlapping communication frequency bands. The first antenna and second antenna having different fundamental modes can be a linear antenna, such as a monopole, dipole, PIFA, or PILA, and an aperture antenna, such as a slot or loop antenna.

20 Claims, 10 Drawing Sheets

CLOSELY SPACED ANTENNAS ISOLATED THROUGH DIFFERENT MODES

FIELD

The present application relates generally to multi-antenna systems.

BACKGROUND

Mobile computing devices have been widely adopted in recent years. Many functions previously performed primarily by personal computers, such as web browsing, streaming, and uploading/downloading of media are now commonly performed on mobile devices. Consumers continue to demand smaller, lighter devices with increased computing power and faster data rates to accomplish these tasks.

Many mobile devices include multiple antennas to provide data rates that satisfy consumers' ever-increasing requirements for upload and download speeds. Integrating multiple antennas into a small form factor device such as a mobile phone or tablet creates the possibility of electromagnetic coupling between antennas. Such electromagnetic coupling has many disadvantages. For example, system efficiency is reduced because signal energy radiated from one antenna is received by another device antenna instead of being radiated toward an intended target. Coupling between antennas becomes even more problematic when the antennas operate at the same or similar frequencies.

Antenna isolation has been attempted through several approaches. One approach is to place antennas sufficiently far apart (e.g., 0.4-0.5 wavelengths) that significant coupling does not occur. Such distances between antennas, however, are not achievable in small form factor devices, especially at lower frequencies. For example, at 700 MHz, antennas would need to be separated by 200 mm (20 cm). Another approach is to create a feedback mechanism that decouples by negating the imaginary part of the mutual impedance. This approach, however, is narrowband and cannot be used for UMTS-like antennas.

Phase-shifting decoupling networks have also been attempted. Because a transmitted signal is known, an out-of-phase version of the transmitted signal can be fed to other antennas to which the transmitted signal is electromagnetically coupled. This creates destructive interference that decouples the antennas. Conventional decoupling networks, however, operate at a single frequency and can also be subject to significant insertion loss that will affect antenna performance.

Orthogonal polarizations of chassis modes have also been attempted with limited success. In this approach, similar antennas (e.g. monopoles) are placed orthogonally on the PCB chassis of a device. Isolation improvement, however, is typically limited to around 3-5 dB, and the device chassis must be large enough to accommodate the orthogonal antennas.

SUMMARY

Embodiments described herein relate to multi-antenna systems. Using the systems described herein, closely spaced antennas can be substantially isolated at a plurality of frequency bands. In one embodiment, a first antenna is operable at a plurality of non-overlapping communication frequency bands. A second antenna is operable at two or more of the plurality of non-overlapping communication frequency bands. The first antenna and the second antenna are closely spaced and have different fundamental modes of operation such that the first antenna and second antenna are substantially isolated at the two or more of the plurality of non-overlapping communication frequency bands.

In some embodiments, the first antenna is a linear antenna and the second antenna is an aperture antenna. Example linear antennas are a planar inverted L antenna (PILA), a planar inverted F antenna (PIFA), a dipole antenna, and a monopole antenna. Example aperture antennas are a slot antenna and a loop antenna.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

The foregoing and other objects, features, and advantages of the claimed subject matter will become more apparent from the following detailed description, which proceeds with reference to the accompanying figures.

DETAILED DESCRIPTION

Embodiments described herein provide multi-antenna systems, including multi-antenna mobile devices. Using the systems described herein, isolation between closely spaced antennas can be achieved by using antennas having different fundamental modes. A "mode" refers to the formation of voltage and current across the antenna structure. The "fundamental mode" is the mode of the lowest resonant frequency of an antenna. Different fundamental modes result in radiation patterns that have low correlation. "Closely spaced" refers to antennas that, if they have similar fundamental modes, are near enough together (e.g. one-tenth of a wavelength) such that a portion of a signal transmitted by one antenna is electromagnetically coupled to another antenna, the coupling being significant enough to detrimentally affect the performance of either antenna. The distance between two antennas can be measured as, for example, the parallel separation distance between two substantially parallel antennas, the distance between the nearest points of each antenna, or the distance between the locations on each antenna that radiate highly. Embodiments are described in detail below with reference to FIGS. 1-12.

Figure 1:
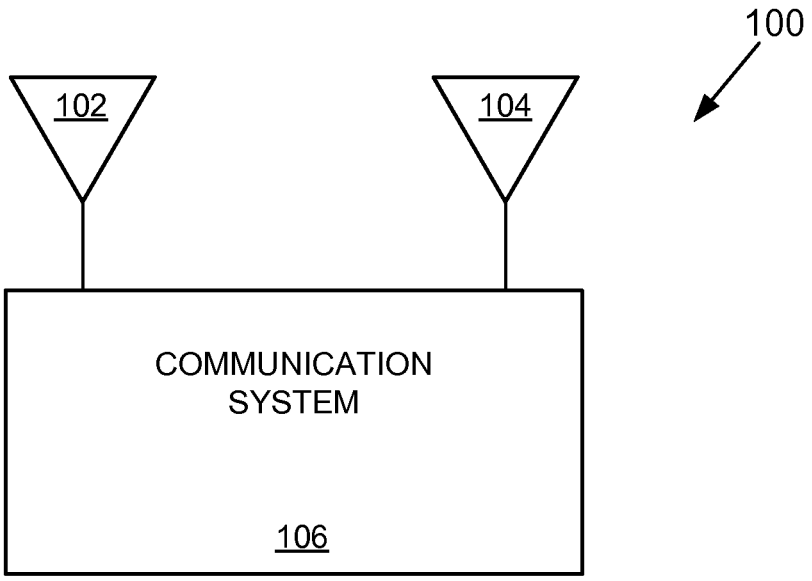
FIG. 1 is a block diagram illustrating an example system having two closely spaced antennas with different fundamental modes of operation.

FIG. 1 illustrates an example system 100. System 100 includes closely spaced antennas 102 and 104. Communication system 106 is connected to antennas 102 and 104. Communication system 106 is beyond the scope of this application but can include various hardware and/or software components that, for example, generate signals for transmission by antennas 102 and 104 or process signals received by antennas 102 and 104. In some embodiments, system 100, including communication system 106, is part of a mobile device such as a mobile phone, smart phone, or tablet computer.

In some embodiments, antennas 102 and 104 are capable of both receiving and transmitting signals. Received signals are communicated to communication system 106, and transmitted signals are communicated from communication system 106 to antennas 102 and 104.

Antenna 102 is operable at a plurality of non-overlapping communication frequency bands. Antenna 104 is operable at two or more of the plurality of non-overlapping communication frequency bands at which antenna 102 is operable. In some embodiments, antennas 102 and 104 are each operable at three or more of the same non-overlapping communication frequency bands. Antennas 102 and 104 are closely spaced and have different fundamental modes of operation such that antenna 102 and antenna 104 are substantially isolated at the two or more of the plurality of non-overlapping communication frequency bands. The different fundamental modes result in radiation patterns of antennas 102 and 104 that have low correlation at the two or more of the plurality of non-overlapping communication frequency bands. Low correlation indicates that antennas 102 and 104 are substantially isolated. In some embodiments, low correlation is a correlation coefficient of approximately less than or equal to 0.4. In some embodiments, substantially isolated is an isolation of at least approximately 10 dB. In other embodiments, substantially isolated is at least approximately 12 dB.

In some embodiments, closely spaced is a separation of less than about one-fourth of the longest wavelength at which both the first and second antenna operate. In other embodiments, closely spaced is a separation of less than about one-tenth of the longest wavelength. As used in this application, wavelength refers to "effective wavelength." Effective wavelength depends on the media (e.g. a PCB substrate or mobile device body) through which a wave travels and can be different from a free-space wavelength.

System 100 can be a multiple-input and multiple-output (MIMO) system. In MIMO systems, multiple antennas are typically used to receive and transmit to achieve faster data rates. In some embodiments, the two or more of the plurality of non-overlapping communication frequency bands at which antennas 102 and 104 both operate are 4G long-term evolution (LTE) frequency bands. Embodiments are contemplated in which both antenna 102 and antenna 104 operate at three or more non-overlapping communication frequency bands in a range from approximately 500 MHz to approximately 2.5 GHz. Other frequency bands are also contemplated.

As discussed above, antennas 102 and 104 have different fundamental modes. For example, one of antennas 102 and 104 may be a linear antenna and the other an aperture antenna. Linear antennas include but are not limited to planar inverted L antennas (PILAs), planar inverted F antenna (PIFAs), dipole antennas, and monopole antennas. Aperture antennas include but are not limited to slot antennas and loop antennas. In one embodiment, one of antennas 102 and 104 is a PIFA or a PILA, and the other of antennas 102 and 104 is a slot antenna.

Figure 2:
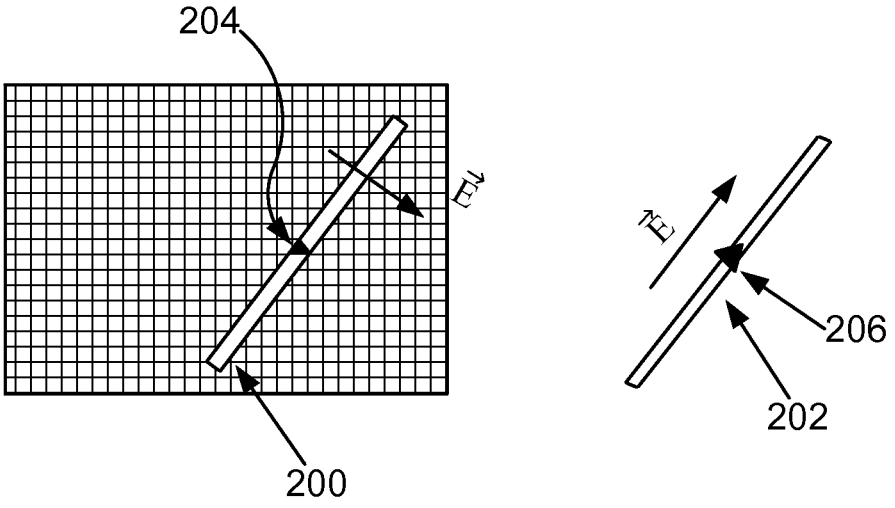
FIG. 2 is a plan view illustrating a pair of example antennas having different fundamental modes.

FIG. 2 illustrates an example aperture antenna 200 and an example linear antenna 202. Aperture antenna 200 is a slot antenna with feed point 204. Linear antenna 202 is a dipole antenna with feed point 206. The fundamental modes of aperture antenna 200 and linear antenna 202 are different, allowing antennas 200 and 202 to be substantially isolated despite being closely spaced. The difference in fundamental mode (and therefore the difference in the formation of current and voltage across antennas 200 and 202) causes, for example, the electric field (E field) at the surface of antennas 200 and 202 to be substantially orthogonal to each other. The radiation pattern formed as radiated waves propagate from antennas 200 and 202 also have a low correlation as a result of the different fundamental modes.

Figure 3:
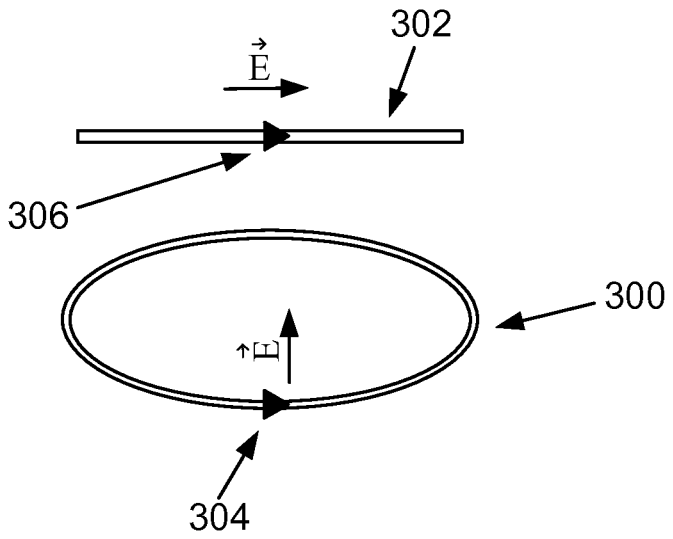
FIG. 3 is a perspective view illustrating a second pair of example antennas having different fundamental modes.

FIG. 3 illustrates another example aperture antenna 300 and another example linear antenna 302. Aperture antenna 300 is a loop antenna with feed point 304, and linear antenna 302 is a dipole antenna with feed point 306. Similarly to FIG. 2, the difference in fundamental mode causes the E field at the surface of antennas 300 and 302 to be substantially orthogonal to each other. The E field of linear antenna 302 is substantially parallel to antenna 302. The E field of aperture antenna 300, however, is substantially normal to the plane containing the area enclosed by antenna 300. Also similarly to FIG. 2, the radiation pattern formed as radiated waves propagate from antennas 300 and 302 have a low correlation as a result of the different fundamental modes.

Figure 4:
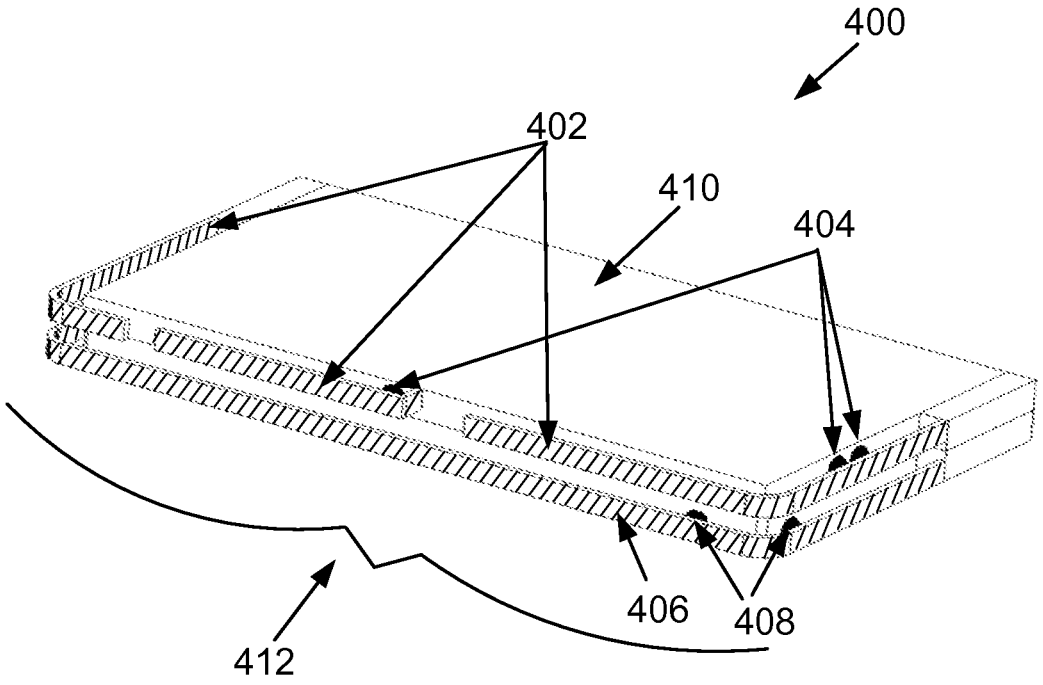
FIG. 4 illustrates a perspective view of an example mobile device having a closely spaced PIFA and slot antenna.
Figure 5:
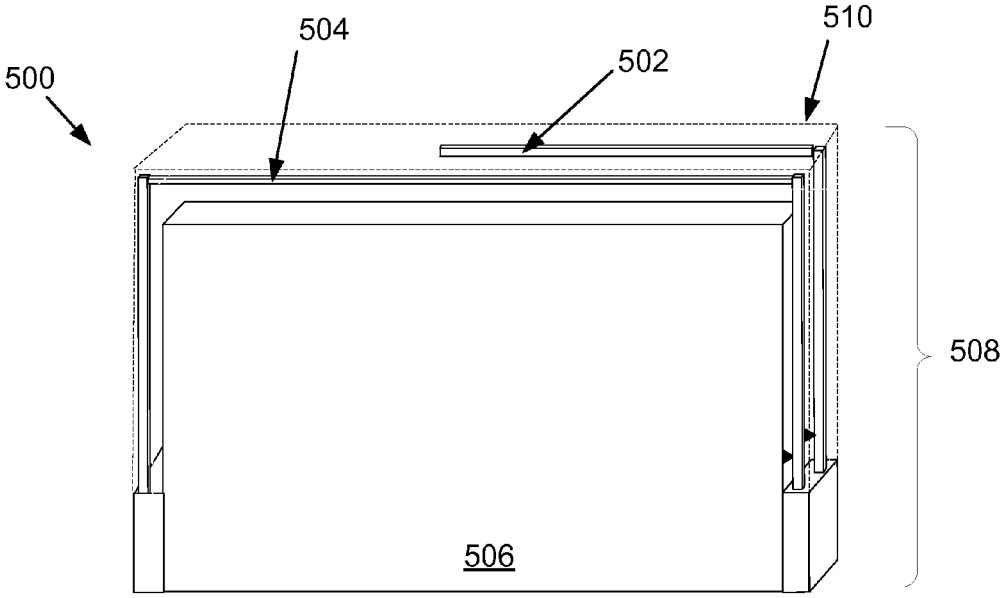
FIG. 5 illustrates a perspective view of an example mobile device having a closely spaced monopole antenna and slot antenna.

FIGS. 4-9B illustrate mobile device embodiments. FIG. 4 illustrates mobile device 400. The exterior housing and other components are not shown for clarity. Mobile device 400 includes linear antenna 402 having a plurality of feed points 404. Linear antenna 402 is a PIFA. Aperture antenna 406 is a slot antenna having a plurality of feed points 408. Linear antenna 402 and aperture antenna 406 are both connected to communication system 410, which in some embodiments contains much of the functionality of mobile device 400. Linear antenna 402 and aperture antenna 406 are located along a same side 412 and near the exterior of mobile device 400. Linear antenna 402 and aperture antenna 406 are closely spaced and in some embodiments are less than approximately ten millimeters parallel distance apart. Because linear antenna 402 and aperture antenna 406 have different fundamental modes of operation, linear antenna 402 and aperture antenna 406 are substantially isolated despite being closely spaced.

FIG. 5A illustrates a mobile device 500 having closely spaced antennas 502 and 504 connected to communication system 506. Antenna 502 is a monopole linear antenna, and antenna 504 is a slot aperture antenna. Antennas 502 and 504 are located along a same side 508 and near the exterior of mobile device 500. The boundary of the housing (not shown) is indicated by dotted line 510.

Figure 6A:
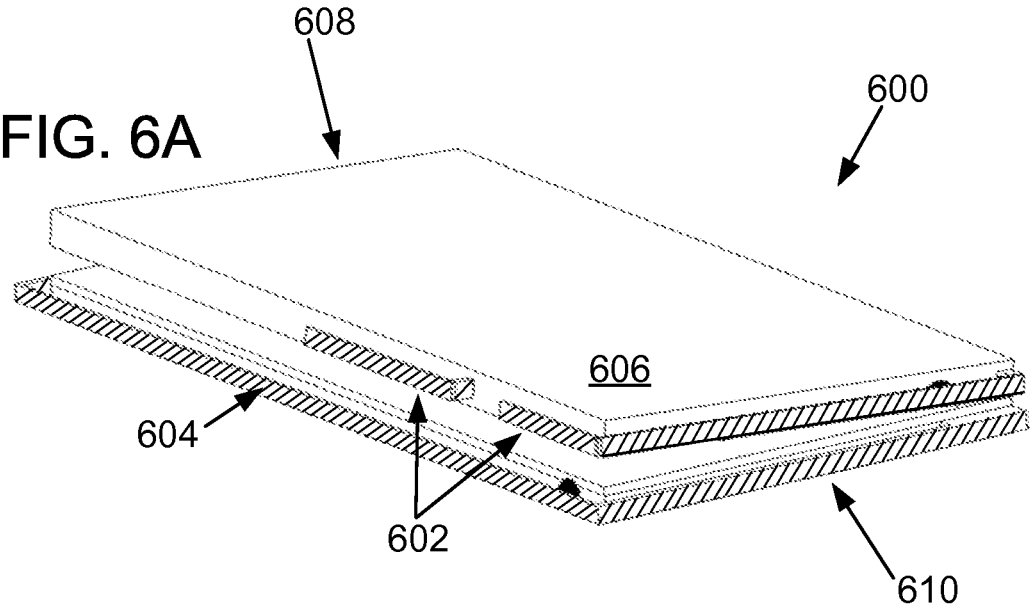
FIG. 6A illustrates a perspective view of an example foldable mobile device having a closely spaced dipole antenna and slot antenna.
Figure 6B:
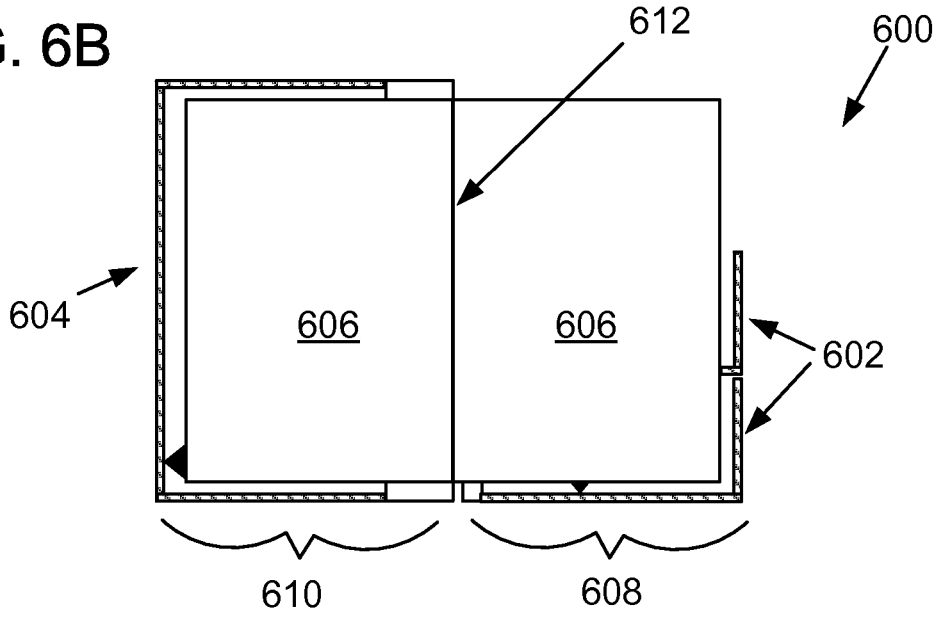
FIG. 6B illustrates a plan view of the example mobile device of FIG. 6A in an open position.

FIGS. 6A and 6B illustrate a foldable mobile device 600 that includes dipole linear antenna 602 and slot aperture antenna 604 connected to communication system 606. In one embodiment, slot aperture antenna 604 acts as the primary antenna, and dipole linear antenna 602 acts as the secondary antenna. FIG. 6A shows mobile device 600 in a nearly closed (or nearly folded) position. Mobile device 600 comprises a first portion 608 containing dipole linear antenna 602 and a second portion 610 containing slot aperture antenna 604. Mobile device 600 is foldable along axis 612, where first portion 608 and second portion 610 are coupled. Dipole linear aperture antenna 602 and slot aperture antenna 604 are substantially parallel and wrap around several edges of mobile device 600 when mobile device 600 is closed. Antenna 602 and antenna 604 are closely spaced because of the small parallel distance (e.g. less than one-tenth of a wavelength) between antenna 602 and antenna 604. When mobile device 600 is closed, dipole linear aperture antenna 602 and slot aperture antenna 604 are substantially isolated because of the different fundamental modes of the antennas. FIG. 6B shows mobile device 600 in an open (or unfolded) position. In some embodiments, when mobile device 600 is open, antenna 602 and antenna 604 are substantially isolated at least in part by the distance between them. In other embodiments, antenna 602 and 604 remain isolated because of the different fundamental modes of the antennas when mobile device 600 is open.

Figure 7A:
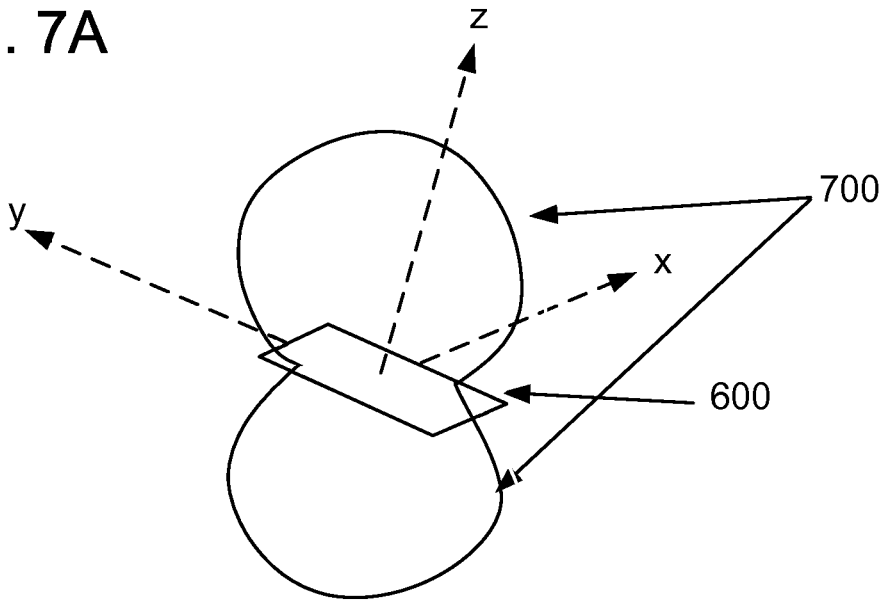
FIG. 7A is a perspective view of the radiation pattern for the slot antenna on a mobile device substantially similar to the device illustrated in FIGS. 6A-6B at 850 MHz.
Figure 7B:
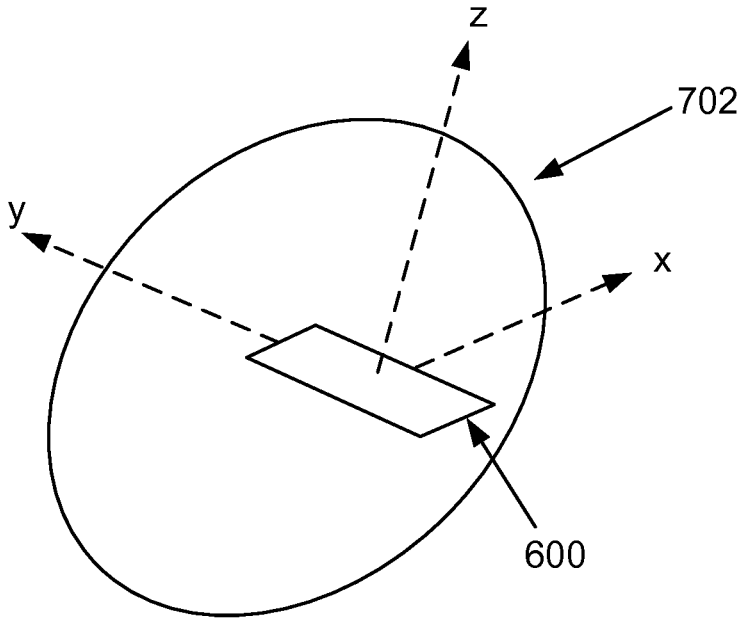
FIG. 7B is a perspective view of the radiation pattern for the dipole antenna on a mobile device substantially similar to the device illustrated in FIGS. 6A-6B at 850 MHz.

FIGS. 7A-8B illustrate the radiation pattern of two antennas of a mobile device substantially similar to antennas 602 and 604 of mobile device 600 in a closed position at two non-overlapping communication frequency bands, 850 MHz and 2000 MHz. FIG. 7A shows a radiation pattern 700 of a slot aperture antenna substantially similar to antenna 604 of FIG. 6 at 850 MHz. The highest intensity of radiation pattern 700 is at the peak of each lobe in the direction of the z axis. FIG. 7B shows a radiation pattern 702 of a dipole linear antenna substantially similar to antenna 602 of FIG. 6 at 850 MHz. The highest intensity of radiation pattern 702 is at the peak of the lobe in the direction of the y axis. It can be understood from FIGS. 7A and 7B that radiation patterns 700 and 702 have a low correlation. Empirical results show a correlation coefficient of less than 0.4. Thus, antennas 602 and 604 are substantially isolated.

Figure 8A:
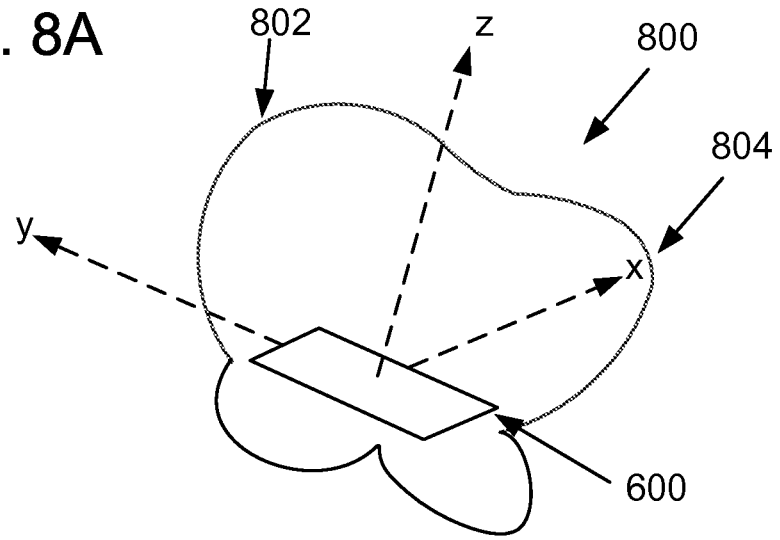
FIG. 8A is a perspective view of the radiation pattern for the slot antenna on a mobile device substantially similar to the device illustrated in FIGS. 6A-6B at 2000 MHz.
Figure 8B:
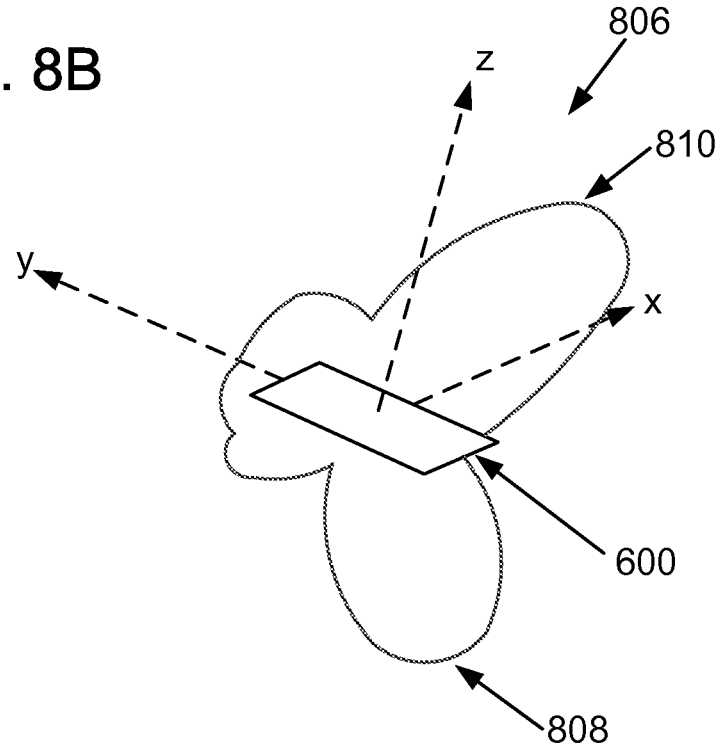
FIG. 8B is a perspective view of the radiation pattern for the dipole antenna on a mobile device substantially similar to the device illustrated in FIGS. 6A-6B at 2000 MHz.

FIGS. 8A and 8B illustrate radiation patterns for antennas substantially similar to antennas 602 and 604 at 2000 MHz. FIG. 8A illustrates a radiation pattern 800 of the slot aperture antenna 604. The highest intensity of radiation pattern 800 is at the peak of the two upper lobes 802 and 804. FIG. 8B illustrates a radiation pattern 806 of dipole linear antenna 602. The highest intensity of radiation pattern 806 is at the peak of the lower lobe 808 and larger upper lobe 810. Similarly to FIGS. 7A and 7B, a visual inspection of FIGS. 8A and 8B shows that radiation patterns 800 and 806 have a low correlation. Empirical results show a correlation coefficient of less than 0.4.

Figure 9:
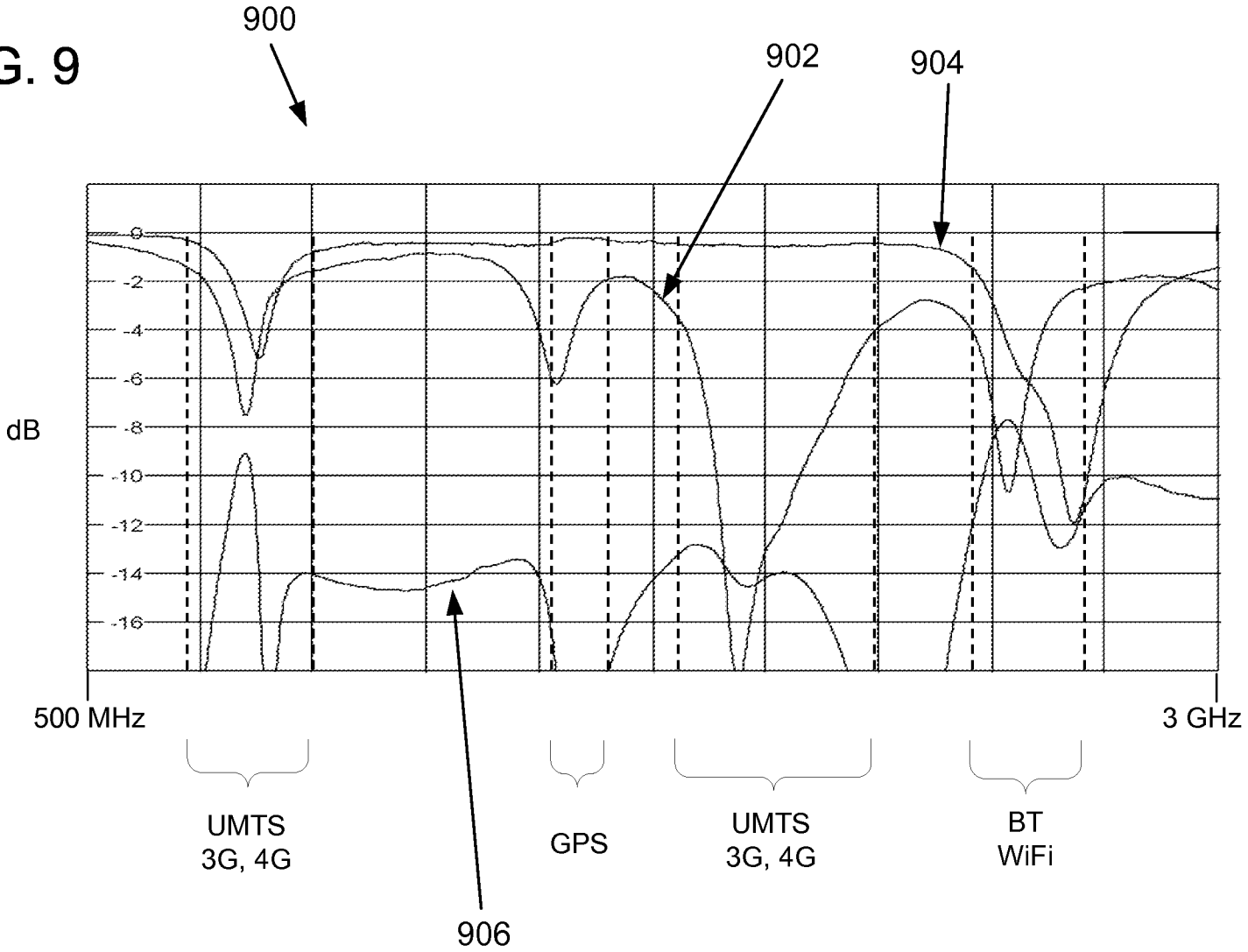
FIG. 9 is a graph illustrating return loss and isolation for the closely spaced antennas on a mobile device substantially similar to the device illustrated in FIGS. 6A-6B.
Figure 10:
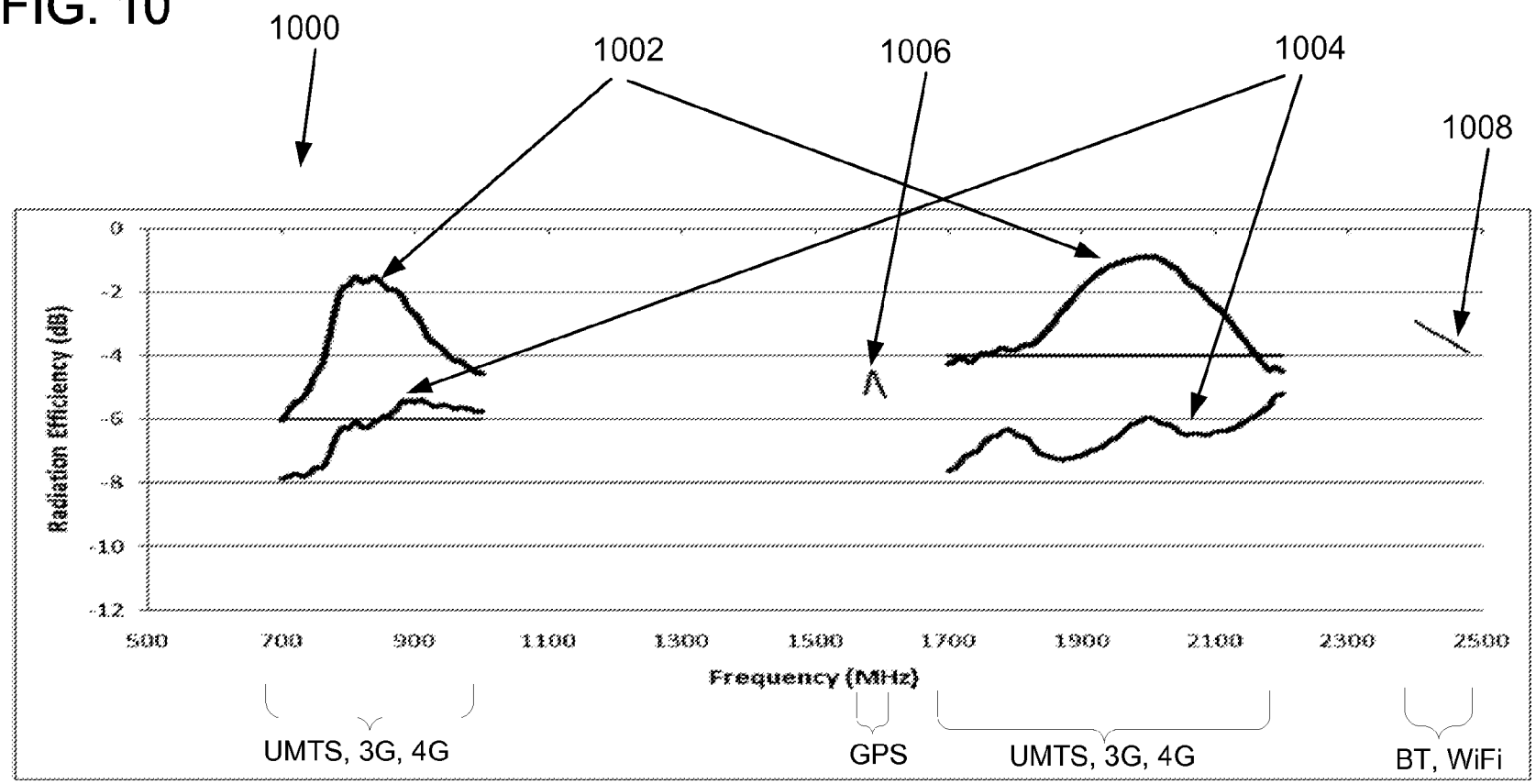
FIG. 10 is a graph illustrating radiation efficiency for the slot aperture antenna on a mobile device substantially similar to the device illustrated in FIGS. 6A-6B.

FIGS. 9 and 10 are graphs of empirical results from testing a mobile device substantially similar to mobile device 600 of FIG. 6. Graph 900 in FIG. 9 shows return loss 902 for a slot aperture antenna substantially similar to antenna 604, return loss 904 for a dipole linear antenna substantially similar to antenna 602, and isolation 906 over a range from 500 MHz to 3 GHz. Return loss is measured by the $S_{11}$ parameter. For return loss, lower values are more desirable and indicate that more of the power provided to the antenna has been radiated beyond the antennas. Graph 900 shows, for example, that in several 3G and 4G bands, both return loss 902 and return loss 904 are low, with return loss 902 reaching approximately −18 dB for at least one frequency. Isolation is represented on graph 900 by the $S_{21}$ parameter. Lower values of $S_{21}$ reflect better isolation. Graph 900 shows that for most frequencies, isolation is better than −12 dB. Frequency ranges are shown for universal mobile telecommunications system, 3G, 4G, global positioning system (GPS), Bluetooth (BT), and WiFi communications.

FIG. 10 shows graph 1000, which illustrates the radiation efficiency of slot aperture antenna 604 at frequencies between 700 MHz and 1000 MHz and between 1700 MHz and 2200 MHz. Efficiency line 1002 is the radiation efficiency in free space, and efficiency line 1004 is the efficiency while a mobile device substantially similar to mobile device 600 is held in the hand. Higher values of radiation efficiency are better. For the 700 MHz and 1000 MHz range, the radiation efficiency shown by efficiency line 1002 is better than approximately −6 dB. For the 1700 MHz to 2200 MHz range, the radiation efficiency shown by efficiency line 1002 is better than approximately −4 dB. Radiation efficiency is typically lower in the hand, and the efficiency shown by efficiency line 1004 is lower over the frequency ranges shown than efficiency line 1002. Graph 1000 also shows efficiency lines 1006 and 1008 for GPS and BT (Bluetooth)/WiFi frequency ranges, respectively, for a slot aperture antenna substantially similar to antenna 604 in free space. Frequency ranges denoted as being associated with a particular standard or communication type (e.g., UMTS, 3G, 4G, GPS, BT, WiFi, etc.) are merely examples.

The particular antennas included in the embodiments illustrated in FIGS. 2-10 are merely illustrative. It is understood that other topologies, combinations of antennas, and placement of antennas within devices are also within the scope of the claims, including combinations of portions of the illustrated topologies. FIGS. 1-10 illustrate two antennas. Additional antennas may also be incorporated using the principles set forth in this application along with conventional antenna design practices.

Example Mobile Device

Figure 11:
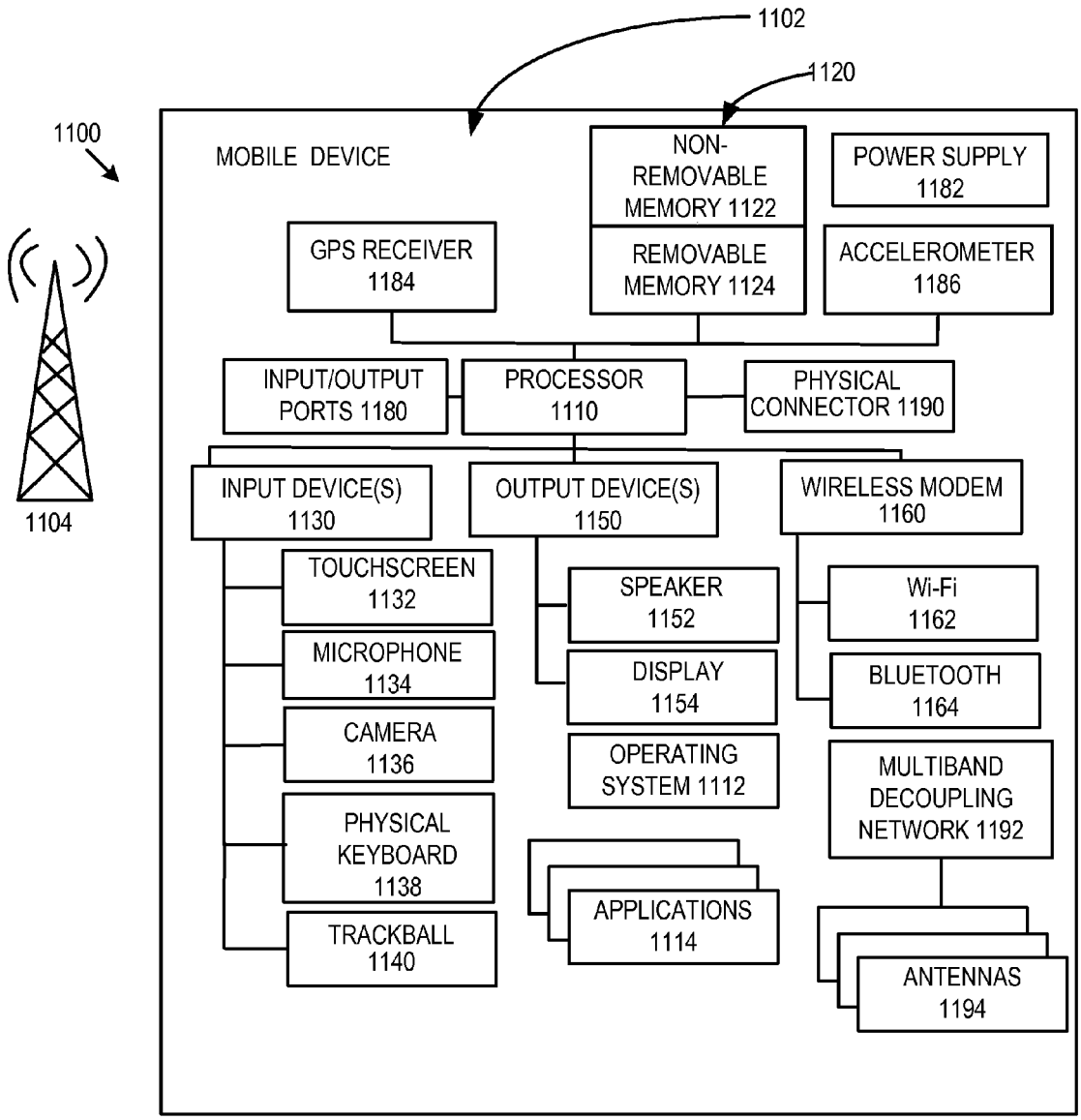
FIG. 11 is a diagram of an example mobile device having multiple antennas and a multiband decoupling network.

FIG. 11 is a system diagram depicting an example mobile device 1100 including a variety of optional hardware and software components, shown generally at 1102. Any components 1102 in the mobile device can communicate with any other component, although not all connections are shown, for ease of illustration. The mobile device can be any of a variety of computing devices (e.g., cell phone, smartphone, handheld computer, Personal Digital Assistant (PDA), etc.) and can allow wireless two-way communications with one or more mobile communications networks 1104, such as a cellular or satellite network.

The illustrated mobile device 1100 can include a controller or processor 1110 (e.g., signal processor, microprocessor, ASIC, or other control and processing logic circuitry) for performing such tasks as signal coding, data processing, input/output processing, power control, and/or other functions. An operating system 1112 can control the allocation and usage of the components 1102 and support for one or more applications 1114. The application programs can include common mobile computing applications (e.g., email applications, calendars, contact managers, web browsers, messaging applications), or any other computing application.

The illustrated mobile device 1100 can include memory 1120. Memory 1120 can include non-removable memory 1122 and/or removable memory 1124. The non-removable memory 1122 can include RAM, ROM, flash memory, a hard disk, or other well-known memory storage technologies. The removable memory 1124 can include flash memory or a Subscriber Identity Module (SIM) card, which is well known in GSM communication systems, or other well-known memory storage technologies, such as "smart cards." The memory 1120 can be used for storing data and/or code for running the operating system 1112 and the applications 1114. Example data can include web pages, text, images, sound files, video data, or other data sets to be sent to and/or received from one or more network servers or other devices via one or more wired or wireless networks. The memory 1120 can be used to store a subscriber identifier, such as an International Mobile Subscriber Identity (IMSI), and an equipment identifier, such as an International Mobile Equipment Identifier (IMEI). Such identifiers can be transmitted to a network server to identify users and equipment.

The mobile device 1100 can support one or more input devices 1030, such as a touchscreen 1132, microphone 1134, camera 1136, physical keyboard 1138 and/or trackball 1140 and one or more output devices 1150, such as a speaker 1152 and a display 1154. Other possible output devices (not shown) can include piezoelectric or other haptic output devices. Some devices can serve more than one input/output function. For example, touchscreen 1132 and display 1154 can be combined in a single input/output device. The input devices 1130 can include a Natural User Interface (NUT). An NUI is any interface technology that enables a user to interact with a device in a "natural" manner, free from artificial constraints imposed by input devices such as mice, keyboards, remote controls, and the like. Examples of NUI methods include those relying on speech recognition, touch and stylus recognition, gesture recognition both on screen and adjacent to the screen, air gestures, head and eye tracking, voice and speech, vision, touch, gestures, and machine intelligence. Other examples of a NUI include motion gesture detection using accelerometers/gyroscopes, facial recognition, 3D displays, head, eye, and gaze tracking, immersive augmented reality and virtual reality systems, all of which provide a more natural interface, as well as technologies for sensing brain activity using electric field sensing electrodes (EEG and related methods). Thus, in one specific example, the operating system 1112 or applications 1114 can comprise speech-recognition software as part of a voice user interface that allows a user to operate the device 1100 via voice commands. Further, the device 1100 can comprise input devices and software that allows for user interaction via a user's spatial gestures, such as detecting and interpreting gestures to provide input to a gaming application.

A wireless modem 1160 can be coupled to an antenna such as one of antennas 1194 and can support two-way communications between the processor 1110 and external devices, as is well understood in the art. The modem 1060 is shown generically and can include a cellular modem for communicating with the mobile communication network 1104 and/or other radio-based modems (e.g., Bluetooth 1064 or Wi-Fi 1162). The wireless modem 1160 is typically configured for communication with one or more cellular networks, such as a GSM network for data and voice communications within a single cellular network, between cellular networks, or between the mobile device and a public switched telephone network (PSTN).

The mobile device can further include at least one input/output port 1180, a power supply 1182, a satellite navigation system receiver 1184, such as a Global Positioning System (GPS) receiver, an accelerometer 1186, and/or a physical connector 1190, which can be a USB port, IEEE 1394 (FireWire) port, and/or RS-232 port.

Mobile device 1100 can also include antennas 1194 having different fundamental modes of operation. Mobile device 1100 can also include one or more matching networks (not shown). The illustrated components 1102 are not required or all-inclusive, as any components can deleted and other components can be added.

Example Operating Environment

Figure 12:
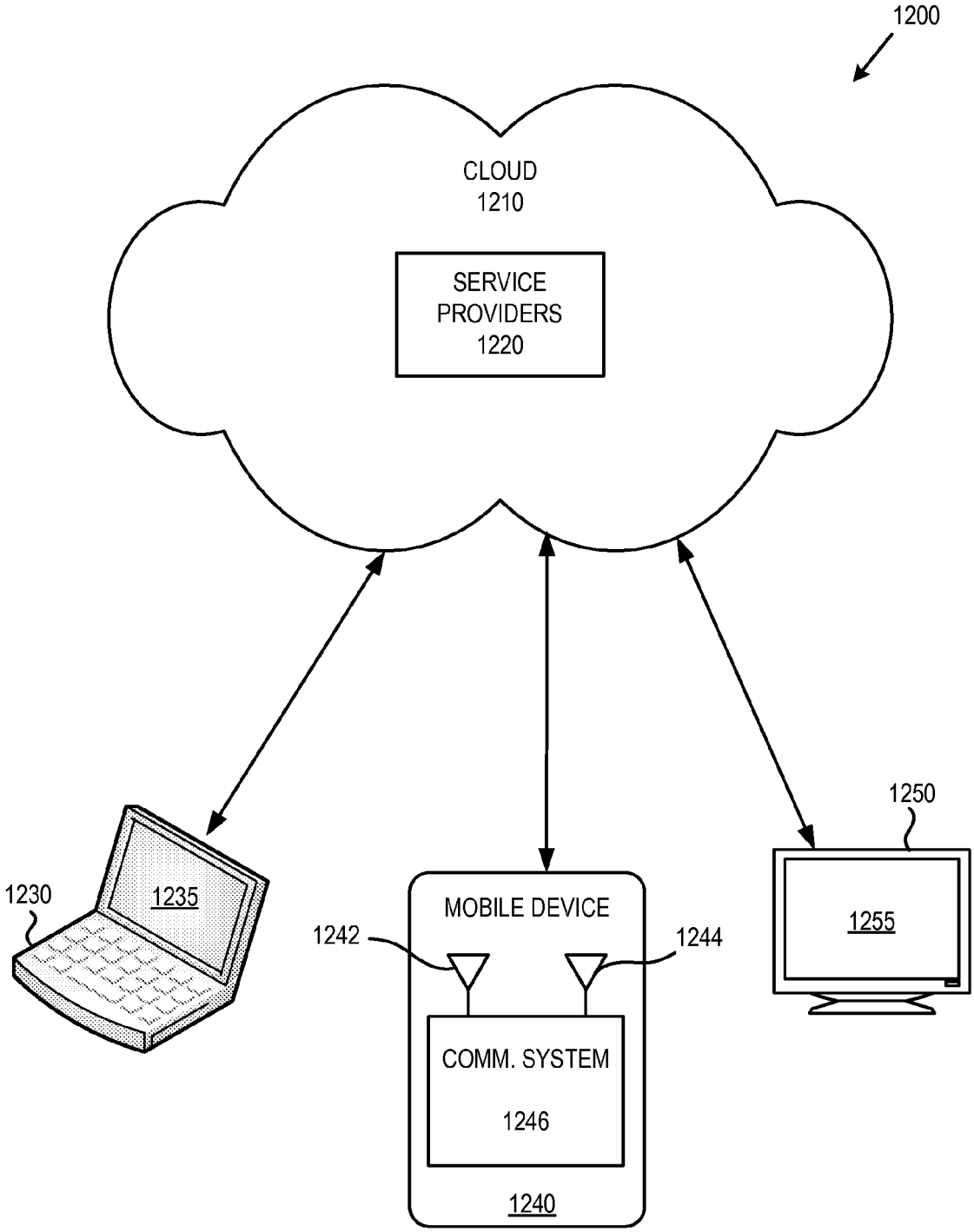
FIG. 12 is a diagram illustrating a generalized example of a suitable implementation environment for any of the disclosed embodiments.

FIG. 12 illustrates a generalized example of a suitable implementation environment 1200 in which described embodiments, techniques, and technologies may be implemented.

In example environment 1200, various types of services (e.g., computing services) are provided by a cloud 1210. For example, the cloud 1210 can comprise a collection of computing devices, which may be located centrally or distributed, that provide cloud-based services to various types of users and devices connected via a network such as the Internet. The implementation environment 1200 can be used in different ways to accomplish computing tasks. For example, some tasks (e.g., processing user input and presenting a user interface) can be performed on local computing devices (e.g., connected devices 1230, 1240, 1250) while other tasks (e.g., storage of data to be used in subsequent processing) can be performed in the cloud 1210.

In example environment 1200, the cloud 1210 provides services for connected devices 1230, 1240, 1250 with a variety of screen capabilities. Connected device 1230 represents a device with a computer screen 1235 (e.g., a mid-size screen). For example, connected device 1230 could be a personal computer such as desktop computer, laptop, notebook, netbook, or the like. Connected device 1240 represents a device with a mobile device screen 1245 (e.g., a small size screen). For example, connected device 1240 could be a mobile phone, smart phone, personal digital assistant, tablet computer, or the like. Connected device 1250 represents a device with a large screen 1255. For example, connected device 1250 could be a television screen (e.g., a smart television) or another device connected to a television (e.g., a set-top box or gaming console) or the like. One or more of the connected devices 1230, 1240, and 1250 can include touchscreen capabilities. Touchscreens can accept input in different ways. For example, capacitive touchscreens detect touch input when an object (e.g., a fingertip or stylus) distorts or interrupts an electrical current running across the surface. As another example, touchscreens can use optical sensors to detect touch input when beams from the optical sensors are interrupted. Physical contact with the surface of the screen is not necessary for input to be detected by some touchscreens. Devices without screen capabilities also can be used in example environment 1200. For example, the cloud 1210 can provide services for one or more computers (e.g., server computers) without displays.

Services can be provided by the cloud 1210 through service providers 1220, or through other providers of online services (not depicted). For example, cloud services can be customized to the screen size, display capability, and/or touchscreen capability of a particular connected device (e.g., connected devices 1230, 1240, 1250).

In example environment 1200, the cloud 1210 provides the technologies and solutions described herein to the various connected devices 1230, 1240, 1250 using, at least in part, the service providers 1220. For example, the service providers 1220 can provide a centralized solution for various cloud-based services. The service providers 1220 can manage service subscriptions for users and/or devices (e.g., for the connected devices 1230, 1240, 1250 and/or their respective users).

In some embodiments, data is uploaded to and downloaded from the cloud using antennas 1242 and 1244 of mobile device 1240. Antennas 1242 and 1244 have different fundamental modes of operation.

Although the operations of some of the disclosed methods are described in a particular, sequential order for convenient presentation, it should be understood that this manner of description encompasses rearrangement, unless a particular ordering is required by specific language set forth below. For example, operations described sequentially may in some cases be rearranged or performed concurrently. Moreover, for the sake of simplicity, the attached figures may not show the various ways in which the disclosed methods can be used in conjunction with other methods.

Any of the disclosed methods can be implemented as computer-executable instructions stored on one or more computer-readable storage media (e.g., one or more optical media discs, volatile memory components (such as DRAM or SRAM), or nonvolatile memory components (such as flash memory or hard drives)) and executed on a computer (e.g., any commercially available computer, including smart phones or other mobile devices that include computing hardware). As should be readily understood, the term computer-readable storage media does not include communication connections, such as modulated data signals. Any of the computer-executable instructions for implementing the disclosed techniques as well as any data created and used during implementation of the disclosed embodiments can be stored on one or more computer-readable media. The computer-executable instructions can be part of, for example, a dedicated software application or a software application that is accessed or downloaded via a web browser or other software application (such as a remote computing application). Such software can be executed, for example, on a single local computer (e.g., any suitable commercially available computer) or in a network environment (e.g., via the Internet, a wide-area network, a local-area network, a client-server network (such as a cloud computing network), or other such network) using one or more network computers.

For clarity, only certain selected aspects of the software-based implementations are described. Other details that are well known in the art are omitted. For example, it should be understood that the disclosed technology is not limited to any specific computer language or program. For instance, the disclosed technology can be implemented by software written in C++, Java, Perl, JavaScript, Adobe Flash, or any other suitable programming language. Likewise, the disclosed technology is not limited to any particular computer or type of hardware. Certain details of suitable computers and hardware are well known and need not be set forth in detail in this disclosure.

It should also be well understood that any functionality described herein can be performed, at least in part, by one or more hardware logic components, instead of software. For example, and without limitation, illustrative types of hardware logic components that can be used include Field-programmable Gate Arrays (FPGAs), Program-specific Integrated Circuits (ASICs), Program-specific Standard Products (ASSPs), System-on-a-chip systems (SOCs), Complex Programmable Logic Devices (CPLDs), etc.

Furthermore, any of the software-based embodiments (comprising, for example, computer-executable instructions for causing a computer to perform any of the disclosed methods) can be uploaded, downloaded, or remotely accessed through a suitable communication means. Such suitable communication means include, for example, the Internet, the World Wide Web, an intranet, software applications, cable (including fiber optic cable), magnetic communications, electromagnetic communications (including RF, microwave, and infrared communications), electronic communications, or other such communication means.

The disclosed methods, apparatus, and systems should not be construed as limiting in any way. Instead, the present disclosure is directed toward all novel and nonobvious features and aspects of the various disclosed embodiments, alone and in various combinations and subcombinations with one another. The disclosed methods, apparatus, and systems are not limited to any specific aspect or feature or combination thereof, nor do the disclosed embodiments require that any one or more specific advantages be present or problems be solved.

In view of the many possible embodiments to which the principles of the disclosed invention may be applied, it should be recognized that the illustrated embodiments are only preferred examples of the invention and should not be taken as limiting the scope of the invention. Rather, the scope of the invention is defined by the following claims. We therefore claim as our invention all that comes within the scope of these claims.

We claim:

1. A multi-antenna system comprising:

a first antenna operable at a plurality of non-overlapping communication frequency bands; and a second antenna operable at two or more of the plurality of non-overlapping communication frequency bands, the first antenna and the second antenna being closely spaced and having different fundamental modes of operation such that the first antenna and second antenna are substantially isolated at the two or more of the plurality of non-overlapping communication frequency bands, wherein the first and second antennas are substantially parallel and located along a same side and near the exterior of a mobile device and spaced less than approximately 10 millimeters parallel distance apart.

2. The system of claim 1, wherein the first antenna is a linear antenna and the second antenna is an aperture antenna.

3. The system of claim 2, wherein the linear antenna is one of a planar inverted L antenna (PILA), a planar inverted F antenna (PIFA), a dipole antenna, or a monopole antenna.

4. The system of claim 2, wherein the aperture antenna is one of a slot antenna or a loop antenna.

5. The system of claim 1, wherein substantially isolated is an isolation of 10 dB or greater.

6. The system of claim 1, wherein closely spaced is a separation of less than about one-fourth of a longest wavelength at which both the first and second antenna operate.

7. The system of claim 1, wherein the system is a multiple-input and multiple-output (MIMO) system.

8. The system of claim 1, wherein the two or more of the plurality of non-overlapping communication frequency bands are 4G long-term evolution (LTE) frequency bands.

9. The system of claim 1, wherein substantially isolated is having a correlation coefficient of approximately less than or equal to 0.4.

10. The system of claim 1, wherein the first antenna and the second antenna are operable and substantially isolated at three or more of the same non-overlapping communication frequency bands.

11. A mobile device, comprising:

a first portion containing a linear antenna operable at a plurality of non-overlapping communication frequency bands; and a second portion containing an aperture antenna operable at two or more of the plurality of non-overlapping communication frequency bands, wherein the linear antenna and aperture antenna have different fundamental modes of operation, and wherein the mobile device is foldable along an axis between the first and second portions such that when the mobile device is open, the linear and aperture antennas are substantially isolated by distance and when the mobile device is closed, the linear antenna and the aperture antenna are closely spaced and are substantially isolated by the different fundamental modes of the linear and aperture antennas.

12. The mobile device of claim 11, wherein the linear antenna is one of a planar inverted L antenna (PILA), a planar inverted F antenna (PIFA), a dipole antenna, or a monopole antenna, and wherein the aperture antenna is one of a slot antenna or a loop antenna.

13. The mobile device of claim 11, wherein closely spaced is a separation of less than about one-tenth of a longest wavelength at which both the linear and aperture antenna operate.

14. The mobile device of claim 11, wherein when the linear antenna and the aperture antenna are closely spaced and substantially isolated by the different fundamental modes, the correlation between radiation patterns of the linear antenna and the aperture antenna is low at the two or more of the plurality of non-overlapping communication frequencies.

15. The mobile device of claim 11, wherein the linear antenna and aperture antenna are part of a multiple-input and multiple-output (MIMO) system.

16. A mobile device comprising:

a linear antenna operable at a plurality of non-overlapping communication frequency bands, the linear antenna being one of a planar inverted L antenna (PILA), a planar inverted F antenna (PIFA), a dipole antenna, or a monopole antenna; and an aperture antenna operable at two or more of the plurality of non-overlapping communication frequency bands, the aperture antenna being one of a slot antenna or a loop antenna, and the linear antenna and the aperture antenna being closely spaced and having different fundamental modes of operation that cause the linear antenna and aperture antenna to be substantially isolated at the two or more of the plurality of non-overlapping communication frequency bands, wherein the linear and aperture antennas are substantially parallel and located along a same edge or edges of the mobile device.

17. The mobile device of claim 16, wherein the mobile device comprises a first portion containing the linear antenna and a second portion containing the aperture antenna and is foldable along an axis between the first and second portions such that when the device is open, the linear and aperture antennas are substantially isolated by distance and when the device is closed, the linear and aperture antennas are closely spaced and are substantially isolated by the different fundamental modes of the linear and aperture antennas.

18. The mobile device of claim 16, wherein closely spaced is a separation of less than about one-tenth of a longest wavelength at which both the first and second antenna operate.

19. The mobile device of claim 16, wherein the linear antenna and aperture antenna are part of a multiple-input and multiple-output (MIMO) system.

20. The mobile device of claim 16, wherein the two or more of the plurality of non-overlapping communication frequency bands are 4G long-term evolution (LTE) frequency bands.

* * * * *